United States Patent [19]

Kohler et al.

[11] 4,019,008

[45] Apr. 19, 1977

[54] ACTUATING MECHANISM FOR SNAP-ACTUATING AN ELECTRIC SWITCHING APPARATUS

[75] Inventors: Werner Kohler, Bentfeld, Holstein; Norbert Steinemer, Berlin, both of Germany

[73] Assignee: Siemens Aktiengesellschaft, Munich, Germany

[22] Filed: Aug. 14, 1975

[21] Appl. No.: 604,834

[30] Foreign Application Priority Data

Aug. 16, 1974 Germany ..... 2439837

[52] U.S. Cl. ..... 200/153 SC; 200/67 A; 200/70

[51] Int. Cl.[2] ..... H01H 3/00

[58] Field of Search ..... 200/153 SC, 67 R, 67 A, 200/65, 70; 74/97, 98

[56] References Cited

UNITED STATES PATENTS 3,122,928 3/1964 Paterson ..... 200/153 SC 3,203,505 8/1965 Hannauer ..... 200/153 SC

*Primary Examiner*—David Smith, Jr.

*Attorney, Agent, or Firm*—Kenyon & Kenyon Reilly Carr & Chapin

[57] ABSTRACT

The invention is directed to an actuator mechanism operating with the energy of a spring which snap actuates an electrical switching apparatus such as a vacuum switching apparatus. The actuator mechanism includes parts which are arranged movably independently of each other, namely, for the cocking motion of the spring and for the switching motion transmitted to the switching contacts of the switching apparatus. These parts cooperate in such a manner that the force of the spring, after being cocked, acts on the part associated with the switching motion automatically. The actuator mechanism is suited, for instance, as a manually operable, fast-acting drive for vacuum power circuit breakers.

2 Claims, 4 Drawing Figures

ACTUATING MECHANISM FOR SNAP-ACTUATING AN ELECTRIC SWITCHING APPARATUS

BACKGROUND OF THE INVENTION

The invention concerns an actuator operating with spring power for the sudden operation of electrical switching apparatus such as vacuum switching apparatus. Actuators of this kind, which are fast-acting switching mechanisms, require a device by which the spring forces are suddenly released if the forces required for the regular operation are stored, that is, the forces required to switch the switching apparatus on or off. This can be accomplished by a latch arrangement which is released automatically when a given angular position of rotatably supported parts is reached. However, such devices consist of a relatively large number of parts.

Accordingly, it is an object of the invention to reduce this expenditure.

SUMMARY OF THE INVENTION

In the actuator mechanism according to the invention, the cocking motion of the spring and the switching motion to be transmitted to the switching location of the switching apparatus are accomplished by parts which are arranged movably independently of each other, and the force of the spring, after being cocked, gets to act on the part associated with the switching motion automatically. Thus, no latches are required for transmitting the spring force to the switching mechanism. This operating principle can be realized in a particularly advantageous manner by arranging the parts associated with the cocking motion and the switching motion so that they are concentrically rotatable, and by providing them with recesses for receiving a drive pin connected with the spring.

The invention is suited particularly for creating actuators with short operating distances and switching angles of less than 180°, wherein a favorable dependence of the forces on the travel distance is achieved during the cocking motion as well as during the switching motion. For this purpose, the cocking wheel may be provided with recess openings for the drive pin at a uniform pitch and can be driven in the same direction of rotation without a return motion.

Although the invention is illustrated and described herein as ACTUATING MECHANISM FOR SNAP-ACTUATING AN ELECTRIC SWITCHING APPARATUS, it is nevertheless not intended to be limited to the details shown, since various modifications may be made therein within the scope and the range of the claim. The invention, however, together with additional objects and advantages will be best understood from the following description and in connection with the accompanying drawings.

DESCRIPTION OF THE PREFERRED EMBODIMENTS OF THE INVENTION

Figure 1:
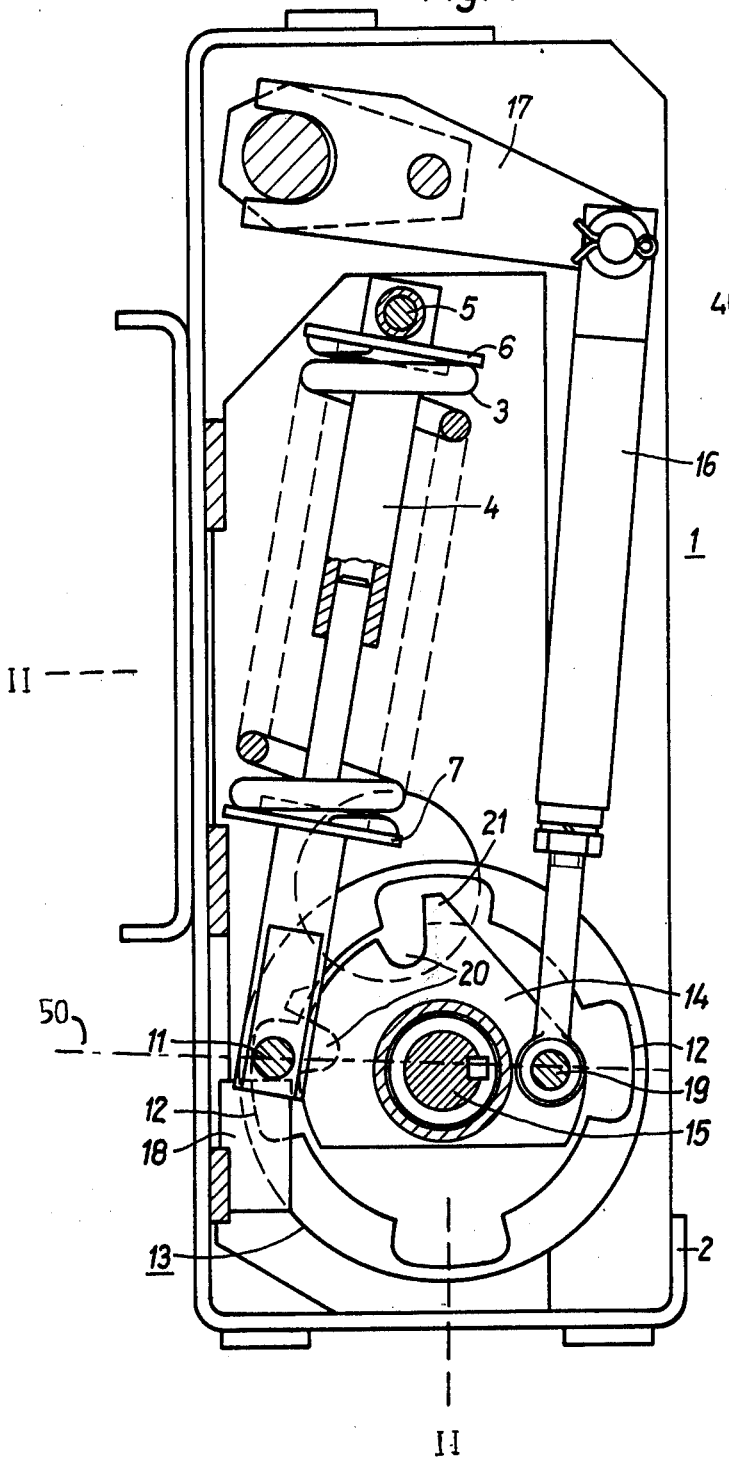
FIG. 1 is an elevation view, partially in section, of a preferred embodiment of the actuator mechanism according to the invention.
Figure 4:
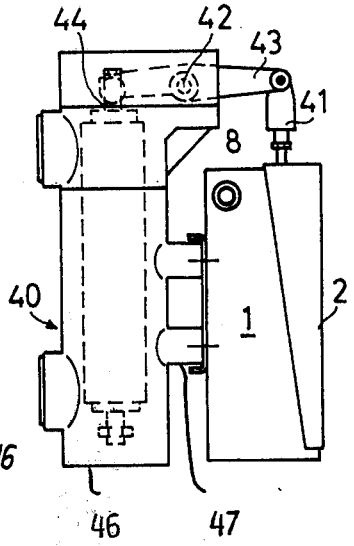
FIG. 4 shows vacuum switching apparatus equipped with an actuator mechanism according to FIGS. 1 to 3.
Figure 2:
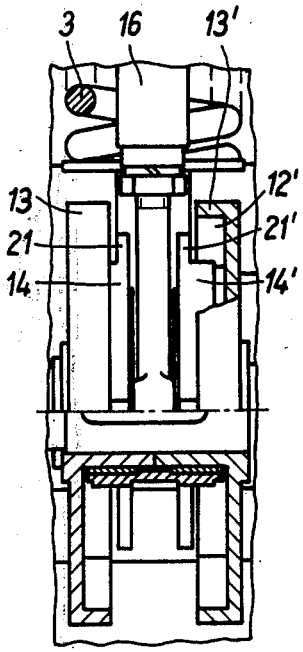
FIG. 2 is a view taken at line II—II to show details of the actuator mechanism of FIG. 1.
Figure 3:
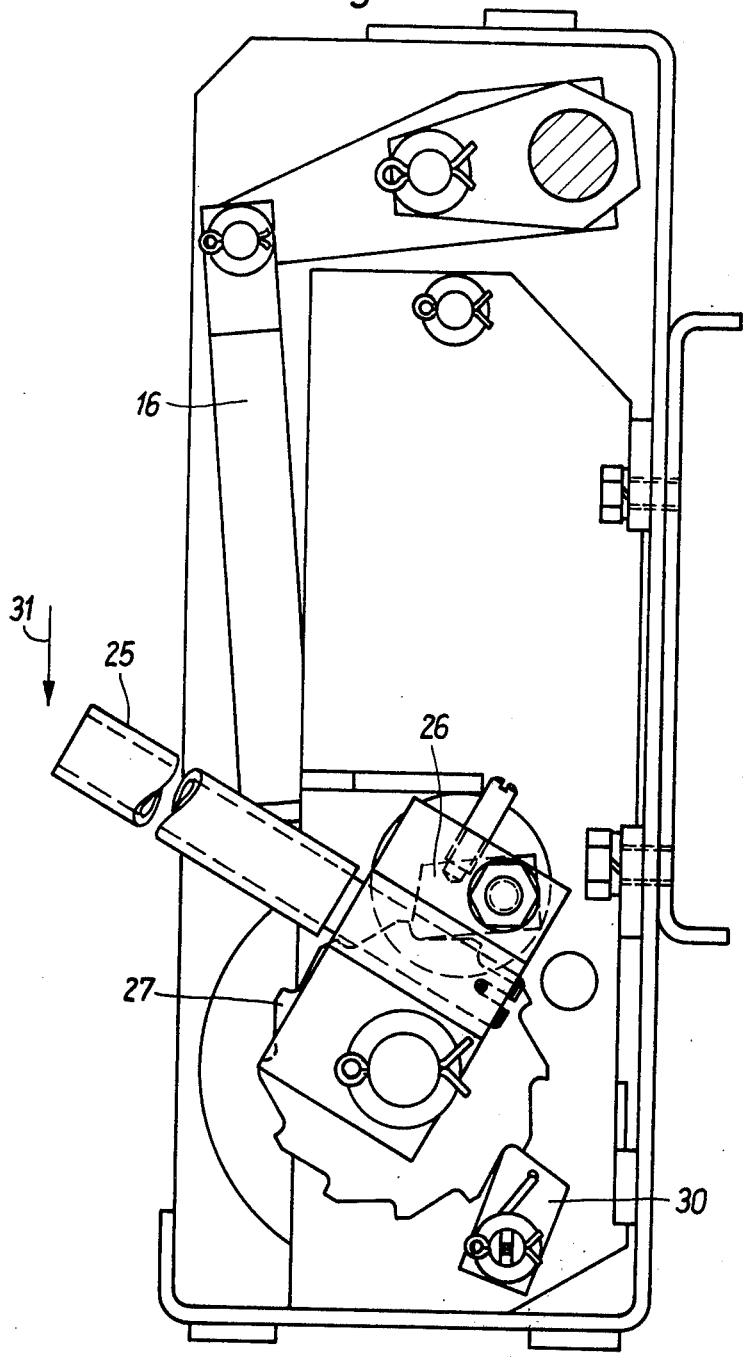
FIG. 3 illustrates the actuating of the actuator mechanism according to the invention by means of hand lever.

The actuator 1 is accommodated in a housing 2, which can serve at the same time as the support for the switching apparatus, not shown in FIGS. 1 to 3. Such apparatus can be a vacuum switching vessel, for instance, which may be mounted as shown in FIG. 4.

The actuator 1 is constructed for switching the switching contacts to the closed position rapidly. For storing the energy required for the switch-closing operation, there is provided spring means which includes a coil spring 3 and a spring carrier 4 on which the spring 3 is arranged. The spring carrier 4 is collapsible and can oscillate about its upper fulcrum 5. The ends of the coil spring 3 are braced against the spring retainers 6 and 7. The lower end of the spring carrier 4 is provided with a take-along bolt in the form of a drive pin 11 which, in the position shown, engages a recess opening 12 of cocking means in the form of a rotatably supported cocking wheel 13. The cocking wheel has a total of four recesses 12 which are distributed so as to be spaced 90° one from the other.

Concentric to the cocking wheel 13 there is arranged a switching segment 14 which is mounted on a switching shaft 15. A coupling member 16 is pivotally connected to the switching segment 14. The coupling member 16 is also pivotally connected to a drive lever 17 which is, in turn, coupled to a switching apparatus such as a vacuum switching vessel (not shown in FIG. 1).

As shown in FIG. 2, two switching segments 14 and 14' are associated with cocking wheels 13 and 13', respectively. The switching segments 14 and 14' and cocking wheels 13 and 13' are provided in a symmetrical arrangement on both sides of the spring carrier 4. This symmetrical arrangement of two switching segments and two cocking wheels serves to ensure a uniform application of the force of the coil spring 3. The switching segments 14 and 14' have recesses 20 and 20', respectively, which are dimensioned for the drive pin 11. The switching segments further have projections 21, 21' adjacent the recesses, respectively, which serves to block any attempt to cock the spring 3 when the switching apparatus is closed. A further stop 18 limits the relaxation of the spring 3.

Thus, the switching segments 14 and 14' constitute part of transmission means for receiving the energy of the spring for transmitting the same to the vacuum switching apparatus independently of the movement of the cocking means.

Drive means including a hand lever 25 (FIG. 3) is provided for operating the actuator 1. The hand lever 25 engages a ratchet wheel 27 by means of a spring-loaded transport pawl 26. The ratchet wheel 27, in turn, is rigidly connected with the cocking wheels 13 and 13'. A further, likewise spring-loaded pawl 30 with a fixed fulcrum ensures that the ratchet wheel 27 can be moved only in the clockwise direction.

In FIG. 1, the actuator is shown in the starting position, in which the switching contacts of the switching apparatus are open. To switch them closed, the hand lever 25 is moved in the direction of the arrow 31. In this way, the ratchet wheel 27 and therefore, the cocking wheels 13 and 13' are moved by the pawl 26 counterclockwise in FIG. 3 (clockwise in FIG. 1) whereby the drive pin 11 engages one of the recesses 12 and thereby cocks the coil spring 3. As the cocking wheels 13 and 13' continue to rotate, the tension of the coil spring 3 increases, while at the same time, the effective lever arm decreases so that the hand lever 25 can be moved easily. As soon as the drive pin 11 gets to the vicinity of the recesses 20 and 20' of the switching segments 14 and 14', it jumps into the recess under the action of the coil spring 3 and exerts a driving force on the switching segments 14 and 14'. The switching segment is thereby rotated until it occupies the position drawn with broken lines. At the same time, the coupling member 16 and the drive lever 17 are moved upward. When the closed position is reached, a detent, not shown, drops in, which locks the switching shaft 15 in the closed position. At the same time, the drive pin 11 has again reached its starting position, in which it passes from the recess 20 to the recess 12 and rests against the stop 18. Thus, the actuator is immediately ready again to switch to the open position.

The coupling member 16 is attached at the switching segments 14 and 14' by means of the joint pin 19 having an axis situated approximately on a straight line 50 through the axes of the drive pin 11 and the switching shaft 15. Because of this selected attachment of the coupling member 16, the lever arm is large at the beginning of the switch-closing motion when the spring force is at its maximum. With the advance of the switching motion and therefore, decreasing spring force, the lever arm also decreases so that a constant or increasing driving force is exerted on the switching contacts of the switching apparatus.

If the switching apparatus is to be switched open, the above-mentioned detent of the switching shaft 15 is released whereby the switching segment 14 with the coupling member 16 and the drive lever 17 is returned to the starting position shown in FIG. 1. The actuator is immediately ready again for a new switching operation if, in the meantime, the hand lever 25 was returned by hand into the position according to FIG. 3 or automatically by the energy of a spring. It is important in this connection that the cocking wheel is always advanced in the same direction of rotation without return motion.

Modifications to the actuator described are possible without straying from the idea of the invention. For instance, the cocking wheels 13 and 13' can be provided with a number of recesses different from the illustrated embodiment if another switching angle is desired or necessary. Further, other energy storage devices, for example, cup springs, torsion springs or flexing springs can also be used instead of the coil spring shown.

The parts of the actuator can be produced and assembled without difficulty by the known methods of metal working. The cocking wheels and switching segments may consist of steel and can be provided with the necessary recesses by chip-removal machining, for example, by milling. The parts mentioned can also be produced in the desired shape by casting, so that further chip-removal machining operations are largely unnecessary. The housing 2 may consist of sheet steel and can be put together from several parts which are first formed by bending and are then joined together by welding. If desired, a removable cover may be provided which protects operating personnel when parts move but can readily be taken off for maintenance.

The vacuum switching apparatus 40 shown in FIG. 4 is intended for medium operating voltages, for example, 24 kV. The apparatus 40 includes an actuator 1 according to FIGS. 1 to 3. A connecting rod 41 protrudes from the housing 2 at the top thereof which is driven in a manner not shown by the shaft 8, on which the drive lever 17 acts (FIG. 1). The connecting rod acts by means of a lever 43 which consists of insulating material and is fulcrumed at 42 on the movable pin 44 of a vacuum switching vessel 45 whose stationary lower pin is held in a clamping device. The vacuum switching vessel is accommodated in a closed insulating housing 46 which has support-like extensions 47 with which it is mounted to the housing 2 of the actuator 1. Several insulating housings 46 can be attached side by side at the actuator 1 so that in this manner a multi-pole switching apparatus is obtained.

What is claimed is:

1. An actuator mechanism for snap-actuating electric switching apparaus such as vacuum switching apparatus comprising: spring means for receiving the energy needed to snap-actuate the vacuum switching apparatus, said spring means including a spring for receiving said energy and a holder assembly having two holding parts movable relative to each other for stressing said spring therebetween, one of said parts including a take-along bolt; cocking means movable for stressing said spring means for imparting thereto said energy for actuating the vacuum switching apparatus, said cocking means comprising mutually adjacent rotatable cocking parts having respective openings formed therein for engaging said take-along bolt and moving the same so as to cause said holding parts to impart said energy to said spring thereby loading said bolt with the energy of said spring; and transmission means for receiving said energy of said spring means and for transmitting the same to the vacuum switching apparatus in a movement independent of said cocking means, said transmission means including mutually adjacent rotatable transmission parts mounted concentrically with said cocking parts so as to be movable independently of the latter, said transmission parts having openings for receiving said take-along bolt therein after said spring has been stressed by said cocking means whereby said bolt applies the energy of said spring to said transmission parts.

2. The actuator mechanism of claim 1, each of said cocking parts having a plurality of openings formed therein and engageable with said take-along bolt, said last-mentioned openings being disposed one next to the other about the periphery of the cocking part; and drive means for driving said cocking parts in a predetermined rotational direction, said drive means including means for preventing said cocking parts from rotating in a rotational direction opposite to said first-mentioned direction.

* * * * *